United States Patent [19]

Mitsui

[11] 4,086,981

[45] May 2, 1978

[54] DRAIN DEVICE FOR OIL PANS

[76] Inventor: Hiroyasu Mitsui, No. 24-9, Amanuma 1-chome, Suginami-ku, Tokyo, Japan

[21] Appl. No.: 733,447

[22] Filed: Oct. 18, 1976

Related U.S. Application Data

[63] Continuation of Ser. No. 586,760, Jun. 13, 1975, abandoned.

[30] Foreign Application Priority Data

Mar. 31, 1975 Japan ..... 50-43311[U]

[51] Int. Cl.[2] ..... F01M 11/04

[52] U.S. Cl. ..... 184/1.5; 137/351; 251/144

[58] Field of Search ..... 184/1.5; 251/144; 137/351; 403/104, 371

[56] References Cited

U.S. PATENT DOCUMENTS

| | | | |
|---|---|---|---|
| 1,992,371 | 2/1935 | Hammond et al. | 184/1.5 |
| 1,995,174 | 3/1935 | Gerrard et al. | 251/144 X |
| 2,095,696 | 10/1937 | Hackel | 184/1.5 X |
| 2,187,247 | 1/1940 | Nichols | 137/351 X |
| 2,509,426 | 5/1950 | Fransen | 184/1.5 |
| 2,657,705 | 11/1953 | Gerhard et al. | 137/351 |
| 2,998,171 | 8/1961 | Jackson | 403/104 X |
| 3,310,133 | 3/1967 | Eaker | 184/1.5 |
| 3,477,459 | 11/1969 | Schossou | 137/351 |
| 3,650,352 | 3/1972 | Schwary | 184/1.5 |
| 3,727,638 | 4/1973 | Zaremba et al. | 184/1.5 X |
| 3,871,483 | 3/1975 | Espinosa et al. | 184/1.5 |
| 3,954,250 | 5/1976 | Grace | 251/144 |

*Primary Examiner*—David H. Brown

*Attorney, Agent, or Firm*—Allegretti, Newitt, Witcoff & McAndrews

[57] ABSTRACT

The drain device disclosed is for removing or draining oil from oil pans utilized on engines of automobiles and similar vehicles. The improved device is mounted in the oil drain outlet of the oil pan and includes a valve which, when opened, permits the oil in the oil pan to drain from the oil pan and which, when closed, prevents the draining of oil from the oil pan. The valve is actuated by a handle or knob which is mounted on the dashboard of the automobile or vehicle.

4 Claims, 3 Drawing Figures

DRAIN DEVICE FOR OIL PANS

This is a continuation of application Serial No. 586,760, filed June 13, 1975, now abandoned, the teachings of which are incorporated herein.

BACKGROUND AND SUMMARY OF THE INVENTION

The present invention relates to an improved drain device for oil pans, and more particularly, to a remotely operated improved device for draining or removing oil from the oil pan of an engine in an automobile or similar vehicle.

In the past, a commonly used method of draining or removing oil from an engine oil pan involved the unscrewing or pulling out a blocking plug from the oil drain outlet of the oil pan. Another commonly used method of draining or removing oil from an engine oil pan included the insertion of an end of a hose into the oil pan through the oil inlet port of the pan and attaching the other end of the hose to a pump that is then used to pump the oil from within the oil pan. However, while these commonly used methods generally accomplish their intended purpose, they do have disadvantages. With respect to the "plug pulling out method", it is necessary for the person draining the oil either to jack up the vehicle or to crawl under the vehicular body in order to be able to unscrew or pull out the blocking plug. With respect to the "pumping method", it is frequently difficult to completely remove all the dirt and sludge accumulated in the bottom of the oil pan. Moreover, both of the aforementioned commonly used methods are accompanied by considerable difficulty and aggravation, and as a result, the oil draining operation is a time consuming and frequently dirty job.

A primary object of my present invention is to provide an improved oil draining device which overcomes the above mentioned disadvantages, which permits facile removal or drainage of the oil from vehicular oil pans, which may be quickly and easily mounted in the oil drain outlet of a conventional oil pan by replacing only a few parts and without modification of the oil pan or its drain outlet and which may be used with and mounted in various sized oil drain outlets without difficulty. According to my present invention, the above object may be achieved by the utilization of an improved oil removal device that comprises a tubular adapter having an externally threaded end adapted to be screwed into the oil drain outlet of an engine oil pan. The main valve body of the improved oil drain device comprises a generally L-shaped tubular body having integral vertically and horizontally disposed tube sections. The vertical tubular section of the L-shaped valve body is connected with the other end of the tubular adapter which, as noted above, is threadedly connected with the oil drain outlet of the engine oil pan. An outlet is provided in the wall of the horizontal tube section of the L-shaped valve body and is downwardly directed so as to form a tap. The interior of the tubular adapter and vertical and horizontal tube sections define a flow path for the flow of oil from the oil pan to the outlet or tap. A cylindrical valve is slidably mounted in the horizontal tube section of the L-shaped valve. This valve is normally spring biased to a first position which blocks or closes the flow path of the oil from the oil pan to the outlet or tap. By the actuation of a handle or knob mounted on the dashboard of the vehicle and connected with the valve by means of a flexible cable, the cylindrical valve may be moved from the closed position to second or open position wherein oil may flow through flow path from the oil pan to the outlet or tap.

These and other objects and advantages of my present invention will become apparent from the following description of the preferred embodiment of my invention.

Figure 1:
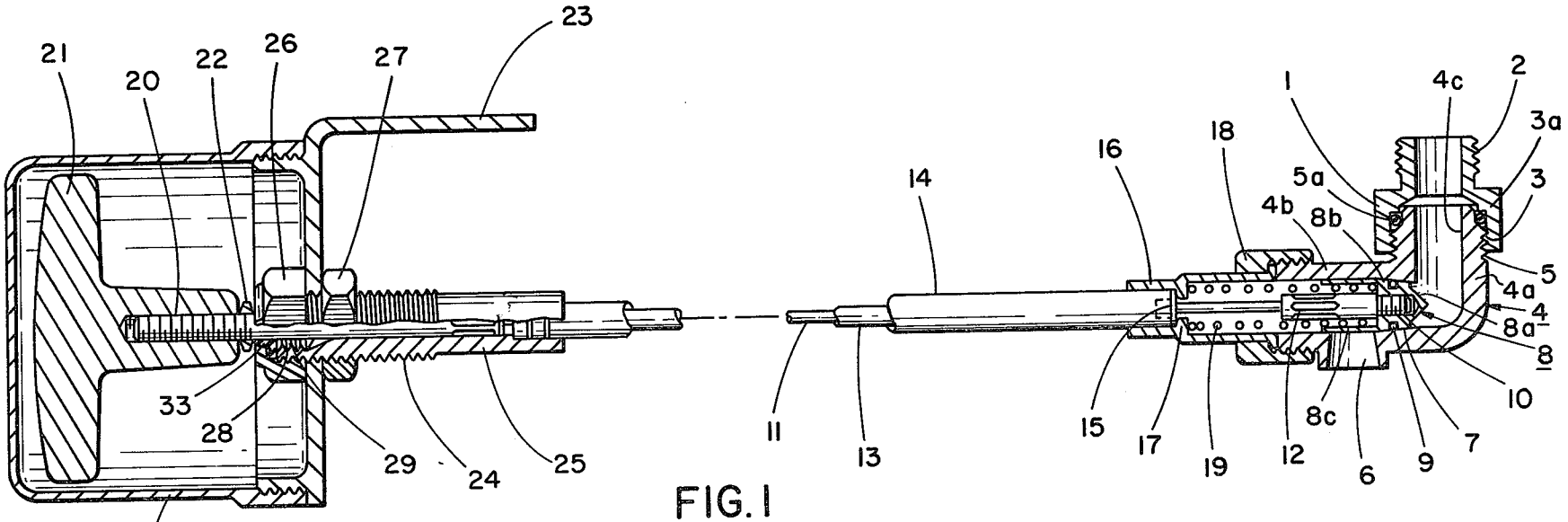
FIG. 1 is a partial cross-sectional view and schematic diagram of an improved oil draining device of the present invention.

In the various figures of the drawings, the same reference numerals are utilized to indicate the same parts. Moreover, the terms "upper", "lower", "right", "left", "right end", "left end", as used herein refer to the device as shown in the drawings and as it would appear to a person looking at the drawings.

DESCRIPTION OF THE PREFERRED EMBODIMENT

Referring now to FIG. 1, a tubular adapter 1 includes an externally threaded end 2 which is adapted to be screwed into the internally threaded oil drain outlet of a vehicular oil pan. Internal thread 3 are formed on the other end 3*a* of the adapter 1. In order for my oil drain device to be usable with oil pans having different diameter oil drain outlets, different adapters, having different diameter ends 2, may be utilized so long as the diameter of the internal threads 3 on the end 3*a* remains uniform.

A main, generally L-shaped, tubular valve body 4 includes an integral vertical tube section 4*a* and horizontal tube section 4*b*. The vertical tube section 4*a* of the valve body 4 defines or forms an inlet port or liquid flow path 4*c* through which oil may flow from the oil pan. The section 4*a* has an externally threaded end 5 adapted to engage the internally threaded end 3 of the tubular adapter 1. An O-ring 5*a* may be inserted between the threaded ends 3*a* and 5 to provide a liquid tight seal therebetween.

A downwardly directed outlet port 6 is formed in the wall of the horizontal tube section 4*b* of the main valve body 4 so as to define a tap from which oil may flow from the valve body 4. As best shown in FIG. 1, the bore of the outlet port 6 has a smoothly tapered cross-section, with the lower end having a larger diameter than its upper end. The inner diameter of the horizontal tube section 4*b* somewhat decreases gradually adjacent to the vertical tube section 4*a* thereby defining a tapered portion 7. The inner diameter of the remaining portion of the interior of the horizontal tube section 4*b*, i.e. the portion to the left of the tapered portion 7, of the horizontal tube section 4*b* of the valve body 4 has a uniform diameter. The interior of the horizontal tube section 4*b* communicates with the lower end of the flow path 4*c* in the vertical tube section 4*a*, and the part of this interior, between the lower end of the flow path 4*c* and the outlet port 6, forms a portion of the flow path for the oil being drained from the oil pan.

A cylindrical valve 8 is slidably mounted in the horizontal tube section 4*b* of the valve body 4. The valve 8 may be made of metal, e.g. brass, and its leading end or right end portion 8*a* is cone shaped. Contiguous to this leading end is a second truncated cone like portion 8b which is dimensioned and arranged to be fitted into the tapered portion 7 of the horizontal tube section 4b. An O-ring 9 is mounted on the valve member 8 about this truncated cone portion 8b to provide a liquid seal between the truncated cone portion 8b and the inner diameter of the horizontal tube section 4b. The cylindrical valve 8 includes an annular, thin wall portion 8c contiguous to and immediately to the left of the truncated cone portion 8b. The thin wall portion 8c is of sufficient length that it overlies the outlet port 6 when the valve 8 is in the right most position. An internally threaded bore 10 is formed in the right end portion 8a of the cylindrical valve 8. A shoulder portion or flange is defined between the bore 10 and the inner facing wall of the annular thin walled portion 8c.

A rod 12 has its externally threaded, right end screwed into the bore 10. The left hand end of the rod 12 is secured, by calking or the like, to the right end of a flexible cable 11 which is made of a plurality of stranded steel wires. The flexible cable 11 is inserted, with a suitable grease, e.g. silicone grease, applied thereto, into a cylindrical liner 13 which in turn is covered with a jacketing 14. The flexible cable 11 extends through a washer 15 which has a cylindrical projection and which is made of plastic such as polyacetal resin. The washer 15 is fitted over the liner 13 and is secured to the liner 13 by, e.g. bonding.

A casing cap 16, preferably made of metal, is connected with the left end of the horizontal tube section 4b of the valve body 4. The casing cap 16 is generally cylindrical in shape but decreases in diameter, adjacent to its left end so as to be able to be fitted onto or over the jacketing 14 of the flexible cable 11 and secured to the jacketing 14 by e.g. bonding. An inwardly directed, annular partition 17 is formed in the casing cap 16 adjacent to the left end of the cap and the flexible cable 11 is adapted to pass through the circular opening defined by the partition 17. The partition 17 divides the cap 16 into two portions, i.e. a left hand portion and a right hand portion which is adjacent to and in communication with the main valve body 4. The casing cap 16 has a radially outwardly projecting flange on its right hand end and is secured to the left hand end of the horizontal tube section 4b by means of a locking member 18 which includes an internally threaded portion adapted to be screwed onto the externally threaded, left hand end portion of the horizontal tube section 4b. A compression spring 19 is disposed within the cap 16 and the left end of the tubular section 4b, with one end of the spring 19 abutting the right side of the partition 17 and the other end abutting the shoulder portion defined between the bore 10 and the annular thin walled portion 8c.

The other or left end of the flexible cable 11 is connected with the right hand end of a rod 20. The other or left hand end of the rod 20 has threads formed thereon and a knob 21 is screwed onto this left end. A lock nut 22 is also threaded onto the left end of the rod 20 and is disposed adjacent to the knob 21 so as to prevent the knob from becoming loose when it is rotated about the longitudinal axis of the rod 20. The knob 21 is adapted to be disposed in the driver's compartment, e.g. on the instrument panel of an automobile adjacent to the driver's seat. Afitting frame 23, which comprises a part of the instrument panel, includes an opening therein in which a tubular holder 25 is mounted. The holder 25 has an externally threaded portion 24 on its outer peripheral surface and is fastened or mounted on the frame 23 by means of a pair of nuts 26 and 27 which cooperate with the externally threaded portion 24. The flexible cable jacketing 14 is secured to the right end of the holder. The left end portion of the internal bore 28 of the holder 25 is of a larger diameter than the remaining portion of the bore. This left hand portion has a plurality of internal threads formed therein and is connected with the remaining portion of the bore by means of a tapered section.

Figure 3:
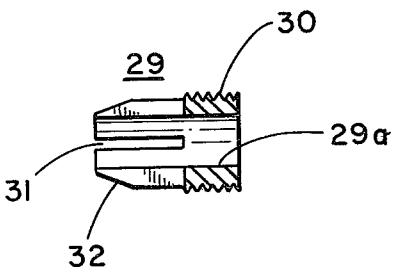
FIG. 3 is a cross-sectional view taken along the line 3—3 in FIG. 2.
Figure 2:
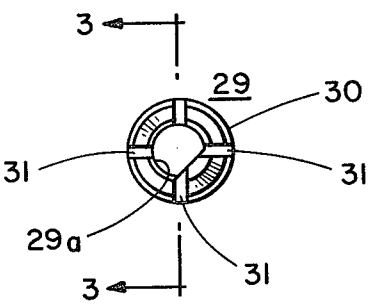
FIG. 2 is a plan end view of a stopper utilized in the improved device shown in FIG. 1.

A stopper 29 is disposed in the threaded bore 28 and is best shown in FIGS. 2 and 3. The stopper 29 includes an internal bore 29a which is shaped, in section, into a partially cut away or imperfect circle. The rod 20 is inserted in the bore 29a and the portion of the rod 20 which extends through the bore 29a has a cross-section that corresponds, in shape, to the imperfect circle shape of the bore 29a so that there can be no relative rotational movement between the stopper 29 and the rod 20. The stopper 29 has external threads 30 which are formed thereon and which are adapted to engage the threads in the bore 28. The stopper 29 also has four slits 31 formed in the end 32 thereof. The end 32 of the stopper is tapered, and the slits 31 therein are parallel to the central, longitudinal axis of the stopper and are spaced 90° with respect to each other about the central longitudinal axis of the stopper. The stopper 29 is disposed in the bore 28 so that its end 32 faces right, i.e. is adjacent to the tapered section of the bore 28.

An annular sealing member 33 is disposed between the nuts 26 and 27 and the holder 25 to minimize the leakage of grease along the rod 20. A cover cap 34 is threadedly connected to the frame 23 and is provided to prevent accidental or unintentional actuation of the knob 21.

My improved oil drain device described above is operated as follows:

First, assuming that the tubular adapter 1 is connected or fitted into the oil drain outlet of the oil pan, the oil from the oil pan flows through the tubular adapter 1 into the vertical tube section 4a of the main valve body 4. The flow of oil is there blocked by the cylindrical valve 8. If the knob 21 is pulled, the tensile force of the knob being pulled causes the cylindrical valve 8, through the rod 20 and the flexible cable 11, to be slid to the left against the bias of the spring 19. This movement of the valve 8 permits the oil to flow into the horizontal tubular portion 4b and out through the outlet 6. In a case where it is desired that the valve 8 is to be retained in its open or leftward position for an extended period of time, the knob 21 may be rotated clockwise. This rotation results in the rod, and thus the stopper 29, being rotated in a similar manner. Such rotation of the stopper 29 causes the stopper to be moved to the right, with respect to the threaded bore 28 of the holder, and thus the slitted end 32 of the stopper is compressed by its engagement with the tapered portion of the bore 28 in the holder 25. This compression causes compression of the flexible cable and thus maintains the cable in its extended position. When it is desired to close the valve 8, the knob need only be rotated in a counter clockwise direction whereby the knob and thus the valve 8 can be returned to its normal right hand closed position as shown in FIG. 1.

As stated above, the improved drain device of the present invention may be utilized with various types of automobiles and vehicles since the only part or component of the device which need be changed to accomodate the various sizes of the oil drain outlets is the tubular adapter 1. Another advantage of my improved oil drain of the present invention is that normally the oil from the oil pan exerts a maximum pressure on the bottom or lower end of the vertical tube section 4*a* and not on the valve 8. Furthermore, since the valve 8 is designed as a cylindrical valve, there is no need of providing any special configuration for the valve seat. Lastly, the improved oil drain device of the present invention has the advantage that it can be operated simply and easily from the driver's seat and does not require the operator to jack up the car body, or crawl under the vehicle in order to drain the oil.

In conclusion, it should be obvious to those having skill in this art that my improved oil drain device can be modified without impairing the function or the simplicity of construction and design. For example, external threads may be provided on the outer surface of the lower end 3 of the tubular adapter and the threads 5 may be formed as internal threads which would mate with these external threads. Furthermore, various other locking means can, of course, be used to attach the knob 21 to the end of the rod 20. Thus, since the invention disclosed herein may be embodied in other specific forms without departing from the spirit or central characteristics thereof, the preferred embodiment of the invention described herein is therefore to be considered in all respects as illustrative and not restrictive, the scope of the invention being indicated by the claims, rather than by the foregoing description and all changes which come within the meaning and the range of equivalency of the claims are therefore intended to be embraced therein.

I claim:

1. An improved device for draining fluid such as oil from the drain outlet of a fluid reservoir such as an oil pan for an engine of an automobile or similar vehicle, comprising:

a main valve body including a tubular body, said tubular body having a vertical tube section, a horizontal tube section, and a juncture therebetween, said vertical tubular section having an upper end and a lower end, the upper end including means for connecting to said drain outlet and the lower end being joined to the horizontal tube section by the juncture, so that the vertical tube section and the horizontal tube section define a fluid flow drain path;

said main valve body further including a valve seat formed within the horizontal tube section, said valve seat having a truncated conical surface with a narrow end adjacent said juncture and a wide end away from said juncture;

an outlet port formed in the horizontal tube section and projecting downwardly to define a tap, said outlet port having a smoothly tapered cross section, a lower port end and an upper port end, said lower port end having a larger diameter than said upper port end, said outlet port being offset horizontally from the juncture;

a valve member slidably mounted in the horizontal tube section, said valve member including an annular thin wall portion, a truncated cone portion and pointed cone-shaped portion, said truncated cone portion being interposed between said annular thin wall portion and said pointed cone-shaped portion, said truncated cone portion defining an annular groove for accommodating an O-ring, said valve member being slidable from a sealed position wherein said pointed cone-shaped portion projects through said valve seat toward said juncture and wherein said truncated cone portion fits against said valve seat and wherein said thin wall portion fits over said tap, to an open position wherein said fluid flow drain path is open to said tap;

a biasing spring projecting into said thin wall portion for exerting a biasing force to bias the valve member to the sealed position; and moving means for moving the valve member against the biasing force from the sealed position wherein the valve prevents fluid flow, to the open position wherein fluid can flow into the horizontal tubular section, past the valve seat and out the outlet port, said moving means including a flexible cable and a knob, said flexible cable having a first end and a second end, said first end being attached to the valve member and said second end being attached to the knob, said knob being disposed at a position remote from the valve member and near to the driver of the vehicle, said moving means also including means for retaining the valve member in the open position.

2. The improved device of claim 1 wherein said thin wall portion includes an internal shoulder for cooperatively engaging the biasing spring, said biasing spring projecting into the thin wall portion and being engaged by the internal shoulder.

3. The improved device of claim 1 wherein said valve member includes a sleeve within said annular thin wall portion for retaining the biasing spring.

4. The improved device of claim 1 wherein said means for retaining the valve member in the open position comprises:

a stopper member with an axis having an axially slitted and externally tapered end section and external threads, said locking member defining a generally cylindrical axial bore and further having at least a first engagement surface along said axial bore;

a generally cylindrical rod member attached to said knob movable axially through said axial bore, in response to movement of said knob, from a first position in which said valve member is in said closed position to at least a second position in which said valve member is in said open position, said rod member having at least a second engagement surface for cooperating with said first engagement surface in at least said second position to rotate said stopper member to a locking position in response to rotation of said knob; and, a holder member having internal threads for mating with said external threads and an internally tapered section for cooperatively engaging said axially slitted and externally tapered end in said locking position to compress said end against rod member, whereby said rod is locked in said second position and said valve member is retained in said open position.

* * * * *